United States Patent [19]

Yates et al.

[11] Patent Number: 4,644,621

[45] Date of Patent: Feb. 24, 1987

[54] CHILLED YARN GUIDE

[75] Inventors: Samuel L. Yates, Lexington, S.C.; Frank L. Peckinpaugh, Petersburg, Va.; Thomas A. Flower, Colonial Heights, Va.; Michael K. Westmoreland, Midlothian, Va.

[73] Assignee: Allied Corporation, Morris Township, Morris County, N.J.

[21] Appl. No.: 462,265

[22] Filed: Jan. 31, 1983

[51] Int. Cl.[4] ..... D02G 1/20; D02J 1/02

[52] U.S. Cl. ..... 28/247; 165/185

[58] Field of Search ..... 105/89; 28/257, 220, 28/258, 266, 246, 212, 247, 254, 255, 256, 261; 57/284, 291, 308; 242/157 R; 165/185

[56] References Cited

U.S. PATENT DOCUMENTS

| | | | |
|---|---|---|---|
| 3,080,134 | 3/1963 | England et al. | 242/157 R |
| 3,114,999 | 12/1963 | Coggeshall | 28/246 |
| 3,382,658 | 5/1968 | McIntosh et al. | 28/246 |
| 3,438,101 | 4/1969 | Le Noir et al. . | |
| 3,643,298 | 2/1972 | Schmick . | |
| 3,781,949 | 1/1974 | Breen et al. . | |
| 3,816,887 | 6/1974 | Smith et al. . | |
| 3,854,177 | 12/1974 | Breen et al. . | |
| 3,953,962 | 5/1976 | Breen et al. . | |
| 3,975,484 | 8/1976 | Okada et al. | 28/254 |
| 4,019,228 | 4/1977 | Ozawa et al. . | |
| 4,024,610 | 5/1977 | Li et al. . | |
| 4,024,611 | 5/1977 | Li et al. . | |
| 4,030,169 | 6/1977 | Enneking et al. . | |
| 4,035,879 | 7/1977 | Schippers | 28/246 |
| 4,040,154 | 8/1977 | Riley . | |
| 4,074,405 | 2/1978 | Li et al. . | |
| 4,090,553 | 5/1978 | Beghin | 165/89 X |
| 4,133,087 | 1/1979 | Li et al. . | |
| 4,135,280 | 1/1979 | Li et al. . | |
| 4,157,604 | 6/1979 | Li et al. . | |
| 4,296,535 | 10/1981 | Li et al. . | |

FOREIGN PATENT DOCUMENTS

| | | | |
|---|---|---|---|
| 0145549 | 12/1980 | German Democratic Rep. | 28/266 |
| 1209816 | 10/1970 | United Kingdom | 28/246 |

*Primary Examiner*—William R. Cline
*Assistant Examiner*—John K. Ford
*Attorney, Agent, or Firm*—Richard A. Anderson; Virginia S. Andrews

[57] ABSTRACT

An improved high speed process for texturing continuous filament yarn is provided wherein the improvement comprises cooling the yarn, subsequent to texturing and prior to applying tension, by contact for at least 4 milliseconds with a curved surface at a temperature of −29° to 2° C. and an RMS of up to 10, frictional forces creating a yarn tension of 0.036 to 0.45 gram per denier per end at the surface. Apparatus is also provided for cooling the continuous filament yarn subsequent to texturing and prior to applying tension. The apparatus comprises a curved surface having a minimum length for yarn contact of 7.6 cm, an RMS of up to 10 and a temperature of −29° to 2° C. Textured yarn brought into contact with the surface for at least 4 milliseconds at a yarn tension of 0.036 to 0.045 gram per denier per end is cooled to increase yarn stability and prevent pullout of yarn texture.

11 Claims, 3 Drawing Figures

CHILLED YARN GUIDE

BACKGROUND OF THE INVENTION

1. Field of the Invention

This invention relates to an improved high speed process for texturing continuous filament yarn, particularly synthetic yarn, such as apparel or carpet yarn. This invention also relates to apparatus for cooling the continuous filament yarn subsequent to texturing and prior to applying tension. This invention is an improvement of the invention disclosed in U.S. Pat. Nos. 4,296,535, 4,157,604, 4,135,280, 4,133,087, 4,074,405, 4,024,611, and 4,024,610, all of which are hereby incorporated by reference. Also of interest are U.S. Pat. Nos. 4,019,228, 3,816,887, 3,643,298 and 3,438,101, also hereby incorporated by reference.

2. The Prior Art

In multiple end processing of continuous filament yarn, a key to successful operation is stabilization of yarn motion after the texturing device. It is well known to use pullout or shake out of the textured wad or plug subsequent to texturing to prepare the yarn for the next processing step and/or prior to take-up. It is also known that the hot textured yarn plug must be sufficiently cool prior to applying tension in order to prevent pullout of yarn texture. At high processing speeds, e.g., at least 2000 meters per minute, the yarn plug heat may not have dissipated prior to contact with the first roll where tension is applied; this will cause deformation of the yarn texture. Also, the yarn will have a tendency to move or "walk" over some of the subsequent rolls in the process, and this pulls the yarn bundle apart. The present invention is directed to overcoming these problems.

U.S. Pat. No. 4,040,154 to Riley teaches the cooling of textured yarn on a transport drum while the yarn is under substantialy zero tension. See also U.S. Pat. No. 4,019,228 to Ozawa et al. U.S. Pat. No. 4,030,169 to Enneking et al. teaches cooling of a crimped wad in the compressed state in a cooling chamber to which room air or cold air is supplied. U.S. Pat. Nos. 3,953,962, 3,854,177, and 3,781,949 to Breen et al. teach cooling crimped yarn, to below the second order transition temperature, on a foraminous surface by passage across a chilled plate or roll prior to imposing any substantial tension on the hot material. All of these patents are hereby incorporated by reference.

SUMMARY OF THE INVENTION

This invention provides an improved high speed process for texturing continuous filament yarn. By high speed process is meant yarn speed of at least 2000, preferably 2400, meters per minute just prior to the texturing device; maximum texturing speed is determined by equipment capability, with 4000 meters per minute being typical. Yarn speed subsequent to the texturing device is somewhat slower. The improvement comprises cooling a yarn, subsequent to texturing and prior to applying tension, by contact for at least 4, typically 4 to 8, and preferably 4 to 6, milliseconds with a curved surface at a temperature of −29° to 2° C. (−20° to 35° F.) and an RMS of up to 10. Frictional forces create a yarn tension of 0.036 to 0.045 gram per denier per end (40 to 50 grams per 1100 denier end) at the surface. Preferred yarn speed is 2400 to 3400 meters per minute, most preferably 3000 to 3100 meters per minute. It is also preferred that the yarn be maintained in running contact with the surface for at least 7.6 cm (3 inches), most preferably for 20 to 36 cm (8 to 14 inches). It is preferred that the curved surface be a cylinder and that the yarn form a 30° to 270° wrap, more preferably 90° to 180° wrap, about the cylinder.

The present invention also provides apparatus for cooling the continuous filament yarn subsequent to texturing and prior to applying tension. The preferred texturing device is an integral, preferably multiple cavity texturing apparatus having the texturing cavity or cavities contained within a single shoe (integral), the shoe also having a special yarn entry orifice with a circular opening diverging to an elliptical opening substantially across each cavity. A wide barrier screen, upon which the yarn from the entry orifice impinges, rotates beneath the cavity or all cavities to carry the wad of crumpled yarn from the texturing cavity exit and beyond to be taken up. Cooling of the barrier screen, or an endless belt/rotary drum serving the same function, or of the yarn while being transported thereby in a tensionless state, is well known in the art and forms no part of the present invention. Yarn exiting the texturing device next encounters the apparatus of the present invention. The apparatus comprises a curved surface having a minimum length for yarn contact of 7.6 cm (3 inches), an RMS of up to 10, and a temperature of −29° to 2° C. (−20° to 35° F). Textured yarn brought into contact with the surface for at least 4 milliseconds at a yarn tension of 0.036 to 0.045 gram per denier per end is cooled to increase yarn stability and prevent pullout of yarn texture.

It is preferred that the curved surface be a cylinder formed of metal. Preferred means for cooling the surface is via conduction, e.g., refrigeration coils or coolant on the concave side of the surface.

The apparatus preferably comprises at least one finger, more preferably five, mounted to and having the same temperature as the surface, each finger separating ends of textured yarn received from a multiple cavity texturing device.

It is also preferred that the surface have an effective diameter of at least 7.6 cm (3 inches), more preferably 15 to 31 cm (6 to 12 inches). The effective diameter of the curved surface is the diameter of the solid generated by closure of the surface, e.g., the diameter of a cylinder generated by closure of a convex arc; the closed surface may form an ellipse in cross-section, in which case the shortest diameter must satisfy the minimum length requirement. Naturally, the curved surface may be closed already, as is preferred, and the effective diameter is then the actual diameter.

The term RMS, which is an abbreviation of root-mean-square, is an arbitrary measurement of surface texture and is described in detail in the publication, Surface Texture (ASA B 46.1-1962), the American Society of Mechanical Engineers, United Engineering Center, 345 E. 47th Street, New York, N.Y., page 16 (1962). The root mean square average is defined by $$Y = \left[ \frac{1}{l} \int_{x=0}^{x=1} y^2 dx \right]^{\frac{1}{2}}$$

where Y=arithmetical average deviation from the center line, y=ordinate of the curve of the profile, and l=the length over which the average is taken.

The apparatus and improved process of the present invention makes possible production of a well textured carpet yarn at high yarn speed, 2000 to 4000 meters per minute, with very high first quality yarn yields and high machine efficiencies.

DESCRIPTION OF THE PREFERRED EMBODIMENT

Figure 1:
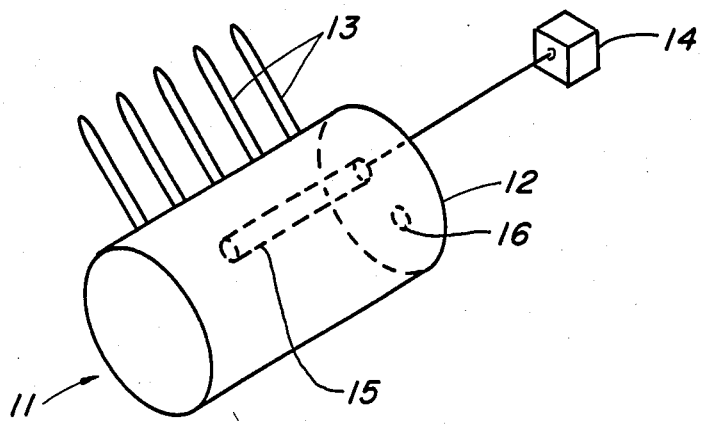
FIG. 1 is a view of a chilled guide 11 of the present invention.

In the accompanying drawings, like numbers indicate like apparatus. Chilled guide 11 of FIG. 1 comprises cylinder 12 with fingers 13 mounted thereto and separating yarn ends 17. Cylinder 12 and fingers 13 are preferably made of a good conduction metal such as stainless steel, chrome plated copper, or brass, preferably the latter. Fingers 13 may be hollow, but preferably are solid metal, and are welded to cylinder 12 in parallel. Cylinder 12 has a diameter of at least 7.6 cm, more preferably 15 to 31 cm, to satisfy the contact length and wrap angle requirements of at least 7.6 cm (20 to 36 cm preferred) and 30° to 270° (90° to 180° preferred), respectively. Contact lengths of less than 7.6 cm will fail to adequately cool the yarn. The yarn contact surface of cylinder 12 has an RMS of up to 10, preferably 2 to 10; at values in excess of 10, the drag on the yarn increases and can pull out the texture of the yarn. To cool cylinder 12, cool air from supply 14 is brought into cylinder 12 via inlet and associated tube 15. Warm air exhausts through outlet 16. The preferred supply of chilled air is cold air exhaust of a Vortex tube, e.g., Model No. 208-15-H, part of 218 experimental outfit manufactured by the Vortec Corporation, Cincinnati, Ohio. Cylinder 12 can be chilled satisfactorily by other means, e.g., refrigeration coils or circulating coolant; it may also be cooled externally, e.g., with air jets. Cylinder 12 is coooled to a temperature of −29° to 2° C. (−20° to 35° F.); at temperatures above 2° C., there is no effect on heat dissipation of the yarn, and it is believed that at temperatures substantially less than −29° C., yarn breakage will occur. An example of a suitable guide shape other than a right circular cylinder with parallel axes is shown in FIG. 2. There, the geometric shape is essentially a convex arc in cross-section, and its effective diameter is that of the right circular cylinder which would be generated by closure of the arc (to form a circle in cross-section).

Figure 3:
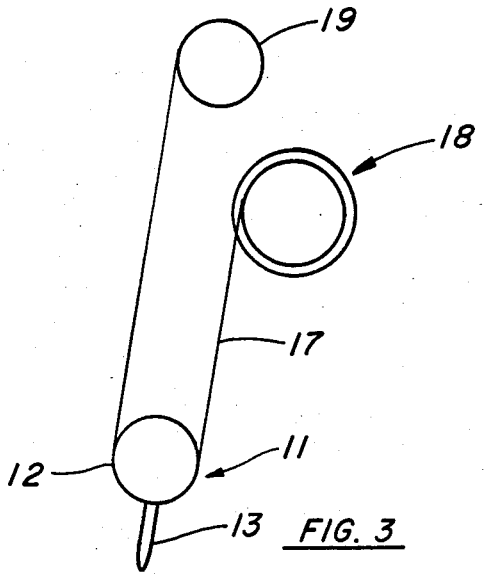
FIG. 3 is a schematic view of a basic arrangement of the apparatus of the present invention together with its related parts.

With reference to FIG. 3, four ends 17 of textured yarn issuing from multiple cavity texturing apparatus 18 are brought into contact with cylinder 12, ends 17 being separated by fingers 13. Yarn ends 17 are introduced to the texturing apparatus 18 at a speed in excess of 2000 meters per minute, preferably 2400 to 3400 meters per minute, most preferably 3000 to 3100 meters per minute. Ends 13 of yarn are maintained in running contact with surface of cylinder 12 for at least 7.6 cm, preferably 20 to 36 cm, and form a 30° to 270° wrap, more preferably 90° to 180° wrap, about the surface of cylinder 12. The yarn is in contact with the curved surface of cylinder 12 for at least 4 milliseconds, preferably 4 to 6 milliseconds. Frictional forces create a yarn tension of 0.036 to 0.045 gram per denier per end (40 to 50 grams per 1100 denier end) at the curved surface of cylinder 12. Yarn ends 17 then travel to take-up roll 19 for further processing or to be wound up.

EXAMPLE 1 (Comparative)

Nylon 6 chips were melt spun using a screw-type extruder in which the temperature was maintained at 270° to 275° C. A 70-hole spinnerette with asymmetric "Y"-shaped capillaries was used. As the polymer exited the spinnerette it was passed through a cross-flow air quench at 100 feet per minute, 65° C. and 65 percent humidity prior to drawing. A spin finish emulsion was employed to assist drawing the fiber. Drawing the fiber consisted of passing it around a non-heated draw roll and idler and then around a pair of heated draw rolls that were maintained at 155° C. Drawing speed was 3100 meters per minute (about 10,200 feet per minute).

The fiber was textured using the apparatus of U.S. Ser. No. 413,403, filed Aug. 31, 1982. Superheated steam was supplied into and through a nozzle 3.8 cm (1.5 inches) long which had an inside diameter of 0.18 cm (0.070 inch). The superheated steam at 260° C. and 90 psig transported the fiber through an energy tube which was 11.10 cm (4.371 inches) long and had an inside diameter of 0.330 cm (0.130 inch). As the fiber exited the energy tube it impinged on a rotating barrier screen at an angle of 60° and was contained by the stationary, integral, multicavity tube. The barrier was a 23 cm (9 inch) diameter stainless steel mesh screen that rotated at 40 RPM and a surface speed of 28.7 meters (94.2 feet) per minute. The barrier was 0.0320 cm (0.0126 inch) thick, had a hole size of 0.0863 cm (0.034 inch) and an open area of 46.2 percent. Each cavity of the integral shoe was 0.508 cm (0.200 inch) deep by 1.27 cm (0.500 inch) wide and 47° long. Impinging the yarn on the barrier initiated crimping of fiber, and momentary retardation of the yarn flow caused the yarn to compact and form a plug or wad of yarn where further crimping took place. At this time the barrier became a transport mechanism for the yarn plug. The yarn plug exited the integral cavity shoe through an opening and was taken up on conventional winders at approximately 2400 meters per minute (7900 feet per minute). The textured yarn produced had a bulk level of 17.3 CEAB, a total boil shrinkage of 12.1 percent and a nominal denier of 1100. The textured yarn was tufted into carpet and dyed as a standard cut-pile fabric. The CEAB means crimp elongation after boiling and is fully described in allowed U.S. Ser. No. 254,348 filed Apr. 15, 1981, hereby incorporated by reference.

EXAMPLE 2

Figure 2:
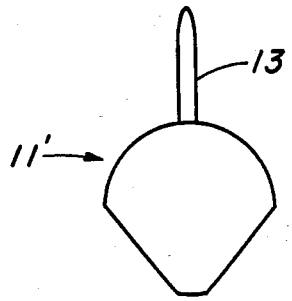
FIG. 2 is a view in cross-section of an alternate guide 11'.

Example 1 was repeated except that subsequent to the yarn plug exiting the integral cavity shoe and prior to take-up, yarn ends 17 were cooled by contact with cylinder 12 of FIG. 1. Cylinder 12 had an outer diameter of 15 cm (6 inches), and fingers 13 had an outer diameter of 1.3 cm (0.50 inch), were 13 cm (5 inches) long and spaced on 1.9 cm (0.75 inch) centers. Cylinder 12 and fingers 13 were made of stainless steel. Yarn ends 17 formed a wrap of 180° about cylinder 12 with which they were in contact for approximately 24 cm (9.4 inches) and a time period of 4 to 6 milliseconds. The surface of cylinder 12 had an RMS of approximately 4 to 8 and was chilled to a temperature of −29° to −23° C. (−20° to −10° F.). The yarn was travelling at a rate of 2600 meters per minute (8500 feet per minute). Cooling of the yarn plug on the barrier screen can be enhanced by vacuum from inside the moving screen transport. An optical plug control sensor can control the location of the yarn plug end where it unfolds for takeup. The textured yarn produced had a bulk level of 18.2 CEAB, a total boil shrinkage of 13.5 percent and a nominal denier of 1100. It can be seen by comparing the CEAB of this example with that of Example 1, that there was less pullout of yarn texture when utilizing the chilled guide 11 of Example 2.

We claim:

1. Apparatus comprising means for texturing multiple ends of a continuous running length of nylon filament yarn, said yarn having no externally applied tension subsequent to texturing a curved surface having a minimum length for yarn contact of 7.6 cm, an RMS (microinches) of up to 10 and a temperature of −29° to 2° C. (−20° to 35° F.) said multiple ends being in contact with said curved surface for at least 4 milliseconds at a yarn tension of at least 0.036 to 0.045 grams per denier per end.

2. The apparatus of claim 1 wherein the surface has an effective diameter of at least 7.6 cm.

3. The apparatus of claim 2 wherein the surface has an effective diameter of 15 to 31 cm.

4. The apparatus of claim 2 wherein the curved surface is a cylinder.

5. The apparatus of claim 1 wherein the surface is metal and is cooled by conduction.

6. Apparatus comprising means for texturing multiple ends of a continuous running length of nylon filament yarn, said yarn having no externally applied tension subsequent to texturing a curved surface having a minimum length for yarn contact of 7.6 cm, an RMA (microinches) of up to 10 and a temperature of −29° to 2° C. (−20° to 35° F.)

at least one finger mounted to the curved surface, said at least one finger separating the multiple ends of textured yarn said multiple ends being in contact with said curved surface for at least 4 milliseconds at a yarn tension of at least 0.036 to 0.045 grams per denier per end.

7. Apparatus of claim 6 wherein said yarn is nylon 6.

8. The apparatus of claim 6 wherein the curved surface has a temperature of −29° to −23° C. (−20° to −10° F.).

9. Apparatus comprising means for texturing multiple ends of a continuous running length of nylon filament yarn, said yarn having no externally applied tension subsequent to texturing a metal cylinder having a curved yarn contacting surface cooled by conduction with temperature of −29° to 2° C. (−20° to 35° F.) having an RMS (microinches) of up to 10, said cylinder having an effective diameter of 7.6 to 31 cm at least one finger mounted to and having the same temperature as said surface, said at least one finger separating multiple ends of textured yarn said multiple ends being in contact with said surface of said cylinder for at least 4 milliseconds at a yarn tension of 0.036 to 0.045 grams per denier per end.

10. The apparatus of claim 9 wherein said yarn is nylon 6.

11. The apparatus of claim 9 wherein the curved surface has a temperature of −29° to −23° C. (−20° to −10° F.).

* * * * *